US007731509B1

(12) United States Patent
Zhang

(10) Patent No.: US 7,731,509 B1
(45) Date of Patent: Jun. 8, 2010

(54) BATTERY CONNECTOR

(75) Inventor: Hong-Tu Zhang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/461,272

(22) Filed: Aug. 6, 2009

(51) Int. Cl.
*H01R 12/00* (2006.01)

(52) U.S. Cl. ..... 439/81; 439/862

(58) Field of Classification Search ..... 439/81, 439/500, 66, 589, 862
See application file for complete search history.

(56) References Cited

U.S. PATENT DOCUMENTS 5,830,007 A * 11/1998 Fry et al. ..... 439/500
6,361,359 B1 * 3/2002 Du et al. ..... 439/500
7,238,045 B1 * 7/2007 Chang ..... 439/500

* cited by examiner

*Primary Examiner*—Phuong K Dinh
(74) *Attorney, Agent, or Firm*—Rosenberg, Klein & Lee

(57) ABSTRACT

A battery connector includes an insulating housing defining a receiving cavity cutting through a top surface and a bottom surface thereof and a conductor accommodated in the corresponding receiving cavity of the insulating housing. The conductor includes a substantial inverted U-shaped contacting portion exposed beyond the top surface of the insulating housing. A pair of substantially symmetrical elastic portions which extends downward from two lower free ends of the contacting portion respectively is restricted in the receiving cavity. A pair of soldering portions extends from two lower ends of the elastic portions. Because the conductor has a substantially symmetrical structure, the force acted on the conductor is shared out equally between the pair of elastic portions. Therefore, the conductor is prevented from offsetting when the battery connector is in use. It ensures the stable contact between the battery and battery connector.

8 Claims, 5 Drawing Sheets

BATTERY CONNECTOR

BACKGROUND OF THE INVENTION

1. Field of the Invention

The present invention relates to a battery connector, and in particular to a battery connector which can ensure a stable electrical connection with a battery.

2. The Related Art

In the mobile communication field, a battery connector is arranged in a mobile phone or other electronic device to electrically connect a battery with an electric board.

Referring to FIG. 5, a conventional battery connector 200 includes an insulating housing 5 and a plurality of terminals 6 accommodated respectively in corresponding receiving cavities 51 of the insulating housing 5. The terminal 6 includes a connecting portion 61, an elastic portion 62 and a locating portion 63. The connecting portion 61 is substantially V-shaped, with one end bent a bit to close the other end. The elastic portion 62 is substantially snake-shaped, with one end extending from the other end of the connecting portion 61 and the other end connects with one end of the locating portion 63. The other end of the locating portion 63 defines a soldering portion 64 thereof.

However, because the elastic portion 62 is substantially snake-shaped, the dissymmetry characteristic of the elastic portion 62 is likely to lead the terminal 6 to offset when the battery connector 200 described above is in use. Therefore, the electrical connection between the terminals 6 and a battery installed in the battery connector 200 is not stable.

SUMMARY OF THE INVENTION

It is an object of the present invention to provide a battery connector capable of connecting with a battery stably.

In order to achieve foregoing objective, the battery connector comprises an insulating housing defining a receiving cavity cutting through a top surface and a bottom surface thereof and a conductor accommodated in the corresponding receiving cavity of the insulating housing. The conductor includes a substantial inverted U-shaped contacting portion exposed beyond the top surface of the insulating housing. A pair of substantially symmetrical elastic portions which extends downward from two lower free ends of the contacting portion respectively is restricted in the receiving cavity. A pair of soldering portions extends from two lower ends of the elastic portions.

As the above description, because the conductor has a substantially symmetrical structure, the force acted on the conductor is shared out equally between the two elastic portions. Therefore, the conductor is prevented from offsetting when the battery connector is in use. It ensures the stable contact between the battery and the battery connector.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
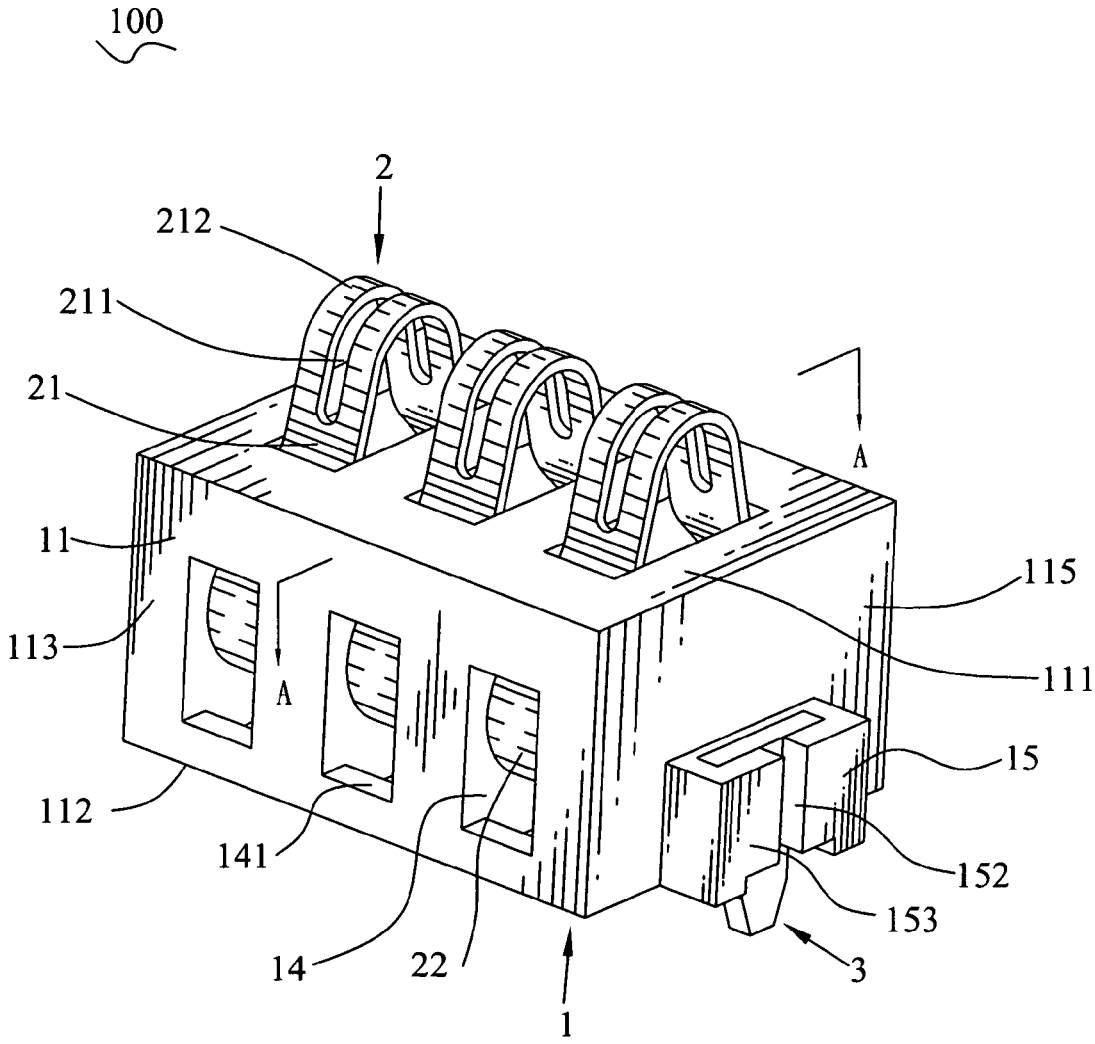
FIG. 1 is a perspective view of a battery connector according to the present invention.

Referring to FIG. 1, the battery connector 100 in accordance with the present invention is formed with an insulating housing 1, a plurality of conductors 2 received in the insulating housing 1 and a pair of fixing pieces 3 inlayed in the insulating housing 1.

Figure 2:
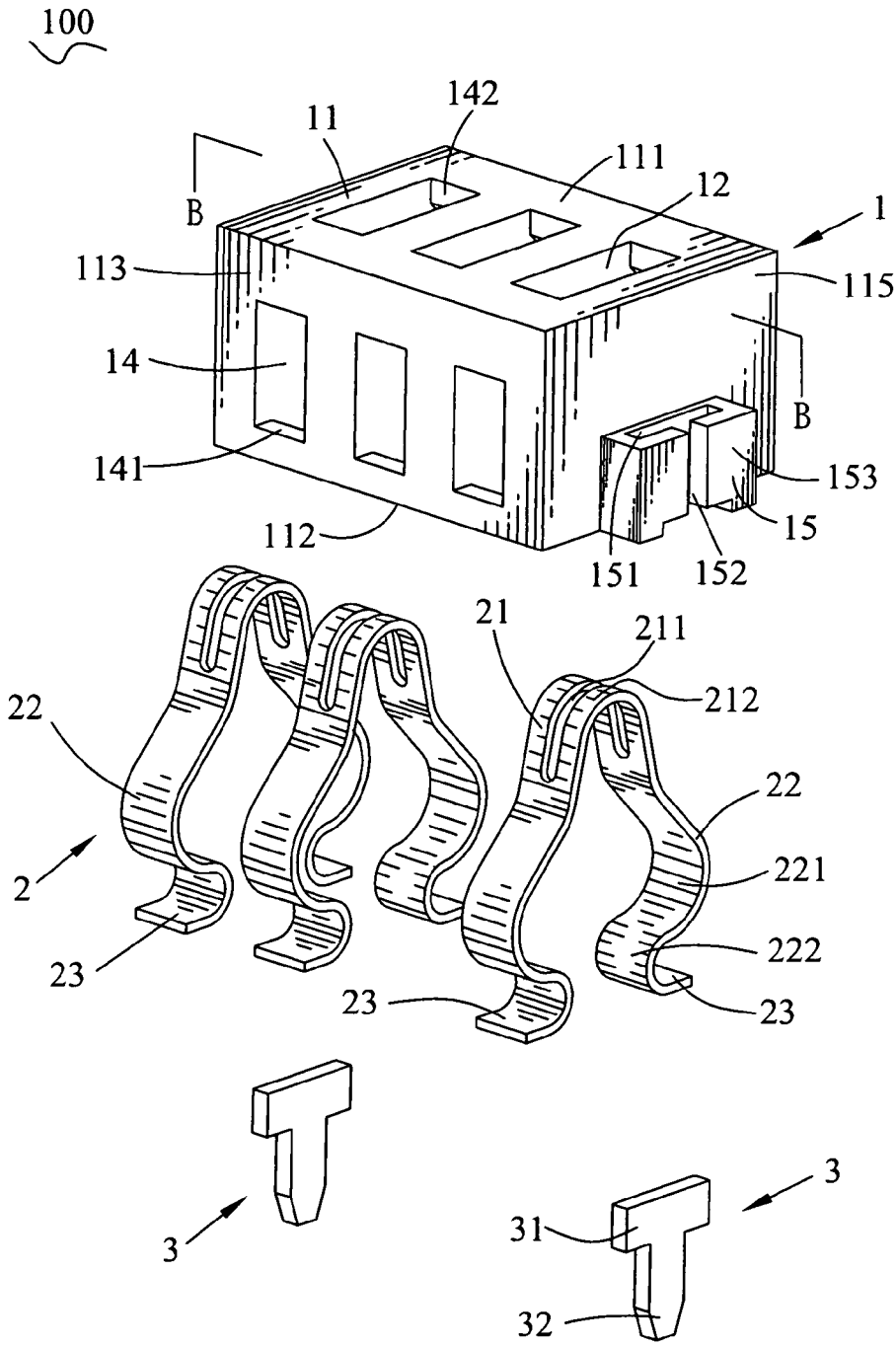
FIG. 2 is an exploded view of the battery connector.
Figure 3:
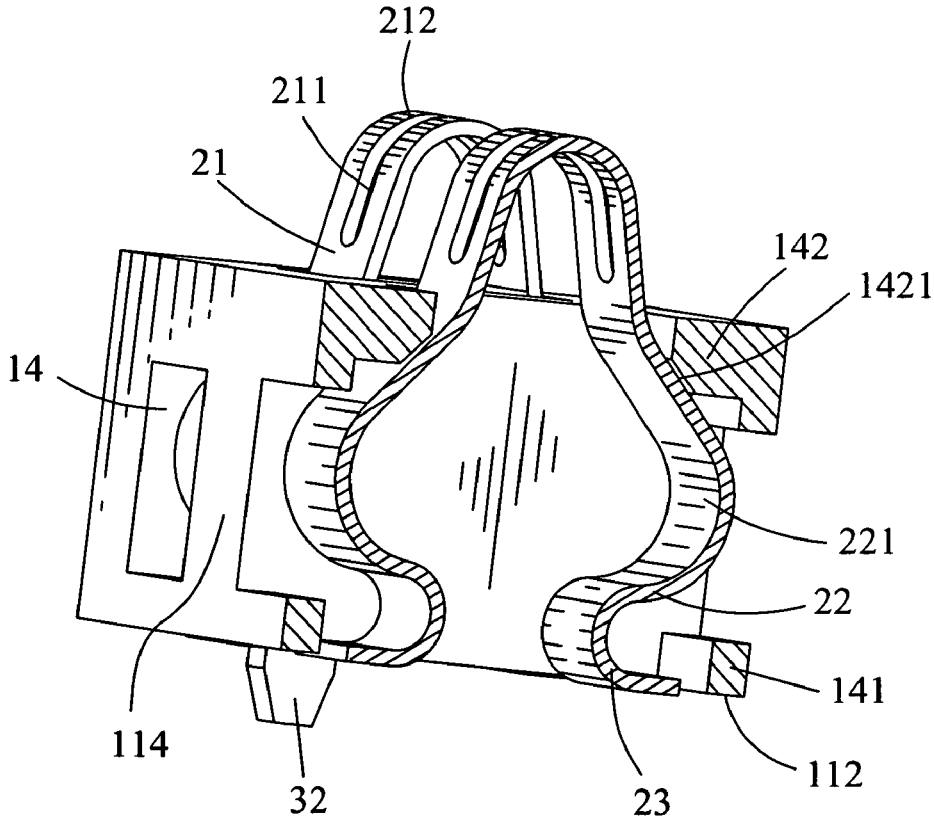
FIG. 3 is a sectional view of the battery connector taken along line A-A of FIG. 1.
Figure 4:
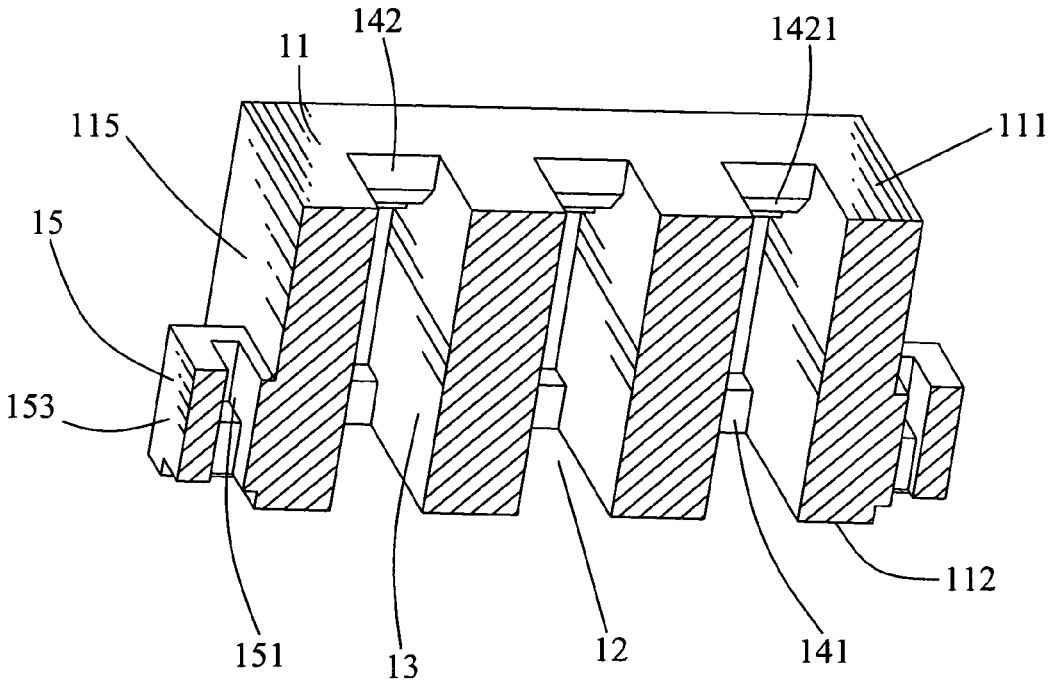
FIG. 4 is a sectional view of an insulating housing taken along line B-B of FIG. 2.
Figure 5:
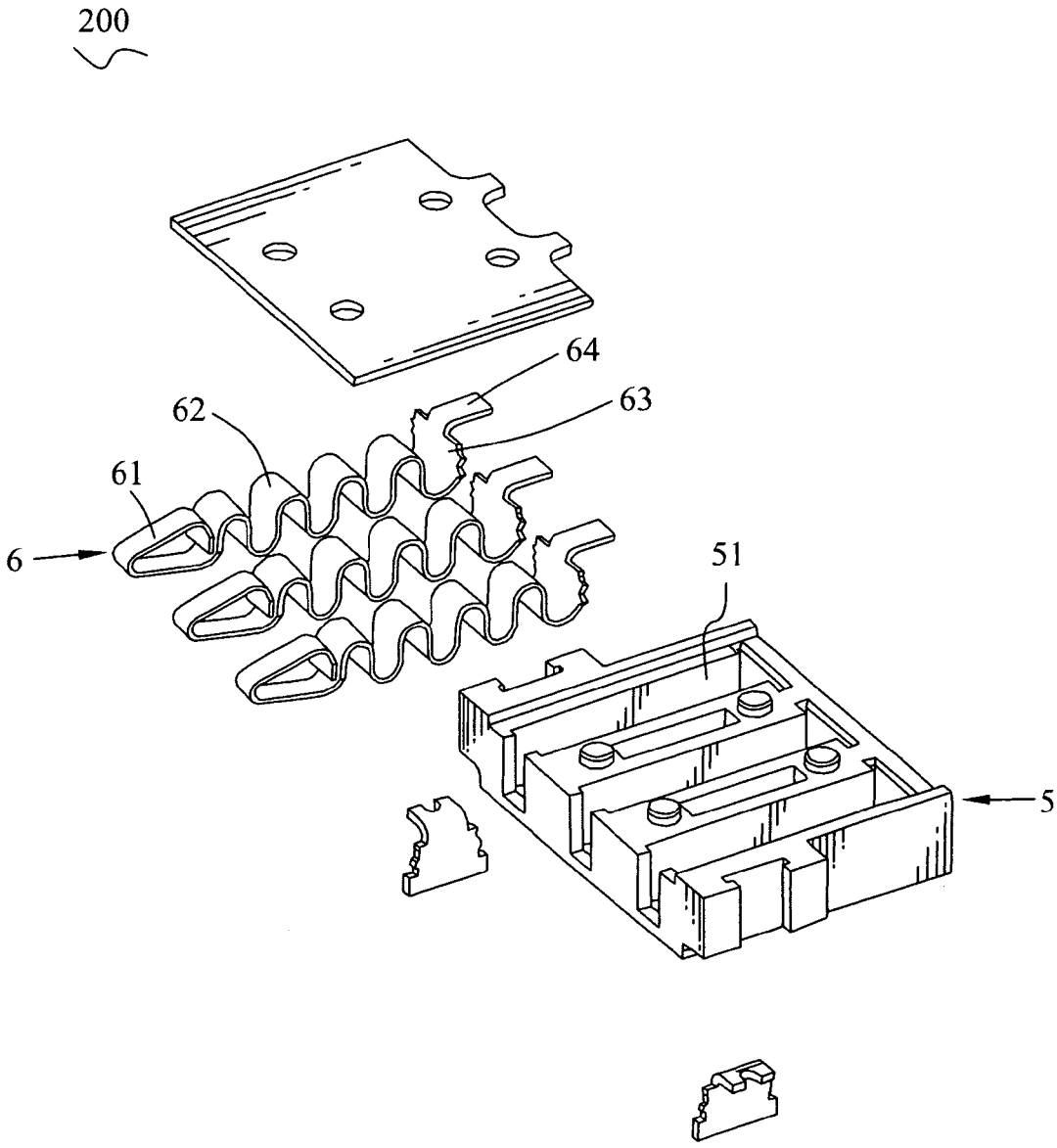
FIG. 5 (PRIOR ART)
FIG. 5 a perspective view of a battery connector according to the teaching of the prior art.

With referring to FIGS. 2-4, the insulating housing 1 shows substantially a rectangular parallelepiped and includes a top surface 111, a bottom surface 112, a front surface 113, a rear surface 114 and two side surfaces 115. The insulating housing 1 further includes a plurality of receiving cavities 12 aligned side by side and spaced from each other. The receiving cavity 12 extends through the top surface 111, the bottom surface 112, the front surface 113 and the rear surface 114 and then forms a rectangle opening 14 in each of the corresponding surfaces. Accordingly, a plurality of beams 141 are respectively formed between the openings 14 in the front and rear surfaces 113, 114 and the corresponding ones in the bottom surface 112. The opening 14 in the top surface 111 has a front side adjacent to the front surface 113 and a rear side adjacent to the rear surface 114. The front side and the rear side of the opening 14 extend toward each other to form a pair of shoulders 142. A lower corner of a free end of each of the shoulders 142 defines an inclined preventing surface 1421. A pair of fixing portions 15 protrudes from a lower portion of each side surface 115 of the insulating housing 1. The fixing portion 15 has a side surface 153 which parallels the side surface 115 of the insulating housing 1 and a T-shaped slot 151 extending therethrough up-and-down and spaced from the side surface 115 of the insulating housing 1. A narrow gap 152 extends therethrough up-and-down and connects a middle portion of the slot 151 to the side surface 153 of the fixing portion 15.

As shown in FIG. 2, the conductor 2, which is accommodated in the corresponding receiving cavity 12 of the insulating housing 1, includes a substantial inverted U-shaped contacting portion 21 and a pair of elastic portions 22 substantially symmetrical with each other extending downward respectively from two lower ends of the contacting portion 21. Two free ends of the elastic portions 22 oppositely extend to form a pair of soldering portions 23 for being soldered to corresponding circuit board (not shown). The contacting portion 21 has two contacting points 212 located at a distance from one another and a crack 211 between the contacting points 212. The elastic portions 22 show substantially S-shaped and have a pair of first arc potions 221 extended downward from the two free ends of the contacting portion 21 and a pair of second arc portions 222 extended downward from lower ends of the first arc portions 221. The two first arc potions 221 arch opposite to each other and the two second arc portions 222 arch towards each other and the first arc portions 221 have a greater radius than the second arc portions 222. Two soldering portions 23 extend opposite each other from lower ends of the second arc portions 222. Therefore, the length of the elastic portions 22 is effectively shortened and the elastic deformation of the conductor 2 is reduced at the same time. Furthermore, because the conductor 2 has a substantially symmetrical structure, the conductor 2 could ensure itself to bear a greater pressure when a battery (not shown) is installed to the battery connector 100 and further to balance the force from the battery.

Please refer to FIG. 2 once again, the fixing pieces 3 is substantially T-shape and has a locating portion 31 and an inserting portion 32 which has a width narrower than that of the gap 152.

Referring back to FIGS. 2-4, in the process of assembly, the conductor 2 is positioned in the corresponding receiving cavity 12 of the insulating housing 1 with the contacting portion 21 exposed out of the insulating housing 1 from the opening 14 in the top surface 111. The two first arc potions 221 of the pair of the elastic portions 22 respectively extend into the opening 14 in the front surface 113 and the opening 14 in the rear surface 114. The pair of the soldering portions 23 are arranged in the opening 14 in the bottom surface to electrically connect with the circuit board. The fixing piece 3 is inserted in the T-shaped slot 151 to locate the insulating housing 1 on the circuit board. The beam 141 could support a lower portion of the first arc portion 221 to prevent the second arc portion 222 being broken by a too great pressure when the battery is installed in the battery connector 100. Because of the shoulder 142, an upper portion of the first arc portion 221 is supported by the inclined preventing surface 1421 of the shoulder 142 when the battery is taken away from the battery connector 100, the elastic force from the conductor 2 cannot make the conductor 2 itself out of the insulating housing 1.

As described above, when the battery is installed in the battery connector 100, the battery compresses the contacting portion 21 of the conductor 2. The compressed contacting portion 21 further presses both of the elastic portions 22 and it causes the elastic portions 22 become deformed. Because the conductor 2 has a substantially symmetrical structure, the force acted on the conductor 2 is shared out equally between the two elastic portions 22. Therefore, the conductor 2 is prevented from offsetting when the battery connector 100 is in use. It ensures a stable contact between the battery and battery connector 100.

What is claimed is:

1. A battery connector, comprising:

an insulating housing defining a receiving cavity cutting through a top surface and a bottom surface thereof; and a conductor accommodated in the corresponding receiving cavity of the insulating housing, the conductor including a substantial inverted U-shaped contacting portion exposed beyond the top surface of the insulating housing, a pair of substantially symmetrical elastic portions extending downward from two lower free ends of the contacting portion respectively and restricted in the receiving cavity, and a pair of soldering portions extending from two lower ends of the elastic portions.

2. The battery connector as claimed in claim 1, wherein the elastic portions include a pair of first arc portions extended downward from the two free ends of the contacting portion and arched opposite to each other and a pair of second arc portions extended downward from lower ends of the first arc portions and arched towards each other to show substantially S-shape.

3. The battery connector as claimed in claim 2, wherein lower ends of the second arc portions extend opposite each other to form the soldering portions.

4. The battery connector as claimed in claim 3, wherein the first arc portion has a greater radius than the second arc portion.

5. The battery connector as claimed in claim 2, wherein upper portions of two opposite sides of the receiving cavity extend towards each other to form a pair of shoulders for restricting the first arc portions in the receiving cavity.

6. The battery connector as claimed in claim 5, wherein a lower corner of each of the shoulders defines an inclined preventing surface for against an upper portion of the first arc portion.

7. The battery connector as claimed in claim 2, wherein the insulating housing further comprises a front surface and a rear surface perpendicularly connecting the top surface and the bottom surface, the receiving cavity extends through the top surface, the bottom surface, the front surface and the rear surface and then forms an opening in each of corresponding surfaces, the openings in the front surface and the rear surface corresponding to the two first arc portions.

8. The battery connector as claimed in claim 1, wherein the insulating housing has two side surfaces, a fixing portion protrudes from a lower portion of each side surface of the insulating housing, the fixing portion has a side surface which parallels the side surface of the insulating housing, a T-shaped slot extending therethrough up-and-down and spaced from the side surface of the insulating housing for receiving a T-shaped fixing pieces which locates the insulating housing on a circuit board, and a narrow gap extending therethrough up-and-down and connecting a substantial middle portion of the slot to the side surface of the fixing portion.

* * * * *